US005489736A

United States Patent [19]

Brierley et al.

[11] Patent Number: 5,489,736

[45] Date of Patent: Feb. 6, 1996

[54] TREATMENT OF SOLID ORGANIC WASTES

[75] Inventors: Kenneth W. Brierley; Michael R. Ellison, both of Warrington, United Kingdom

[73] Assignee: British Nuclear Fuels PLC, United Kingdom

[21] Appl. No.: 256,090

[22] Filed: Jul. 21, 1994

[30] Foreign Application Priority Data

Oct. 27, 1992 [GB] United Kingdom ..... 9222590

[51] Int. Cl.[6] ..... G21F 9/00

[52] U.S. Cl. ..... 588/1; 210/759; 423/20; 376/311; 976/DIG. 376

[58] Field of Search ..... 588/1, 18, 20; 423/17, 18, 20; 376/311; 976/DIG. 376; 210/759

[56] References Cited

U.S. PATENT DOCUMENTS

| | | | |
|---|---|---|---|
| 3,669,631 | 6/1972 | Dietrich et al. | 423/20 |
| 3,778,497 | 12/1973 | Deaton et al. | 423/2 |
| 4,681,705 | 7/1987 | Robertson | 588/20 |
| 4,690,782 | 9/1987 | Lemmens | 134/3 |
| 4,797,128 | 1/1989 | Fowler | 8/137 |
| 5,205,999 | 4/1993 | Willis et al. | 423/20 |
| 5,322,644 | 6/1994 | Dunn et al. | 588/7 |

FOREIGN PATENT DOCUMENTS

| | | |
|---|---|---|
| 0282810 | 6/1990 | European Pat. Off. . |
| 533494A2 | 3/1993 | European Pat. Off. . |
| 550221A1 | 7/1993 | European Pat. Off. . |
| 2299410 | 8/1976 | France . |
| 2229312A | 9/1990 | United Kingdom . |

*Primary Examiner*—Ngoclan Mai
*Attorney, Agent, or Firm*—Nixon & Vanderhye

[57] ABSTRACT

A process for the treatment of material which is or is suspected to be contaminated with one or more actinides or compounds thereof, which process includes contacting the said material with a liquid medium which comprises an aqueous solution which is free of heavy metal ions (prior to use thereof) and comprises ingredients which are naturally degradable to non-toxic products with or without mild physical assistance such as heat or ultra-violet radiation, said solution comprising:

(a) carbonated water;

(b) a conditioning agent; and (c) a complexing agent which comprises the anion of a carboxylic acid having from 2 to 6 carbon atoms;

wherein the said process is for treatment of solid organic wastes which are or are suspected to be contaminated with plutonium or compounds thereof with or without other hazardous contaminants and includes the steps of shredding the organic waste material, intimately mixing the shredded waste material with the said liquid medium thereby dissolving contaminants as complexes in said liquid medium and separating the said liquid medium from the shredded waste material thereby reducing the radioactivity level of the organic waste material.

12 Claims, No Drawings

TREATMENT OF SOLID ORGANIC WASTES

The present invention relates to the treatment of solid organic wastes and particularly to processes suitable for the treatment of wastes which are or are suspected to be contaminated with plutonium or compounds thereof.

Published GB 2229312A by the present applicants describes an aqueous medium comprising a solution which was designed for the purpose of dissolving, to enable separation of, actinides contained in so-called Magnox sludge resulting from the long-term storage underwater of irradiated nuclear fuel encased in containers made of Magnox, a magnesium alloy:

The said solution herein referred to as "Solution X" is as follows:

Solution X comprises an aqueous solution which is free of heavy metal ions (prior to use thereof) and comprises ingredients which are naturally degradable to non-toxic products with or without mild physical assistance such as heat or ultra-violet radiation, said solution comprising:

(a) carbonated water;

(b) a conditioning agent; and (c) a complexing agent which comprises the anion of a carboxylic acid having from 2 to 6 carbon atoms.

We have discovered that Solution X unexpectedly and beneficially has other applications. The said Solution X may be used in the treatment of organic wastes as follows:

According to the present invention there is provided a process for the treatment of material which is or is suspected to be contaminated with actinides or compounds thereof, which process includes contacting the said material with a liquid medium which comprises Solution X as defined hereinbefore, wherein the said process is for treatment of solid organic wastes which are or are suspected to be contaminated with plutonium or compounds thereof with or without other hazardous contaminants and includes the steps of shredding the organic waste material, intimately mixing the shredded waste material with the said liquid medium thereby dissolving contaminants as complexes in said liquid medium and separating the said liquid medium from the shredded waste material thereby reducing the radioactivity level of the organic waste material.

The process according to the present invention provides a method of treating solid organic waste so that highly active plutonium contaminants contained in the waste are leached from the waste by dissolution in the said liquid medium comprising Solution X thereby converting the waste to a substantially safer condition. The waste treated by the process of the present invention may for example be so called PCMs which are plutonium-contaminated materials obtained from a plant in which plutonium is handled as a material for use in or a product of a nuclear fission reaction. The organic materials in this case may include waste textiles or rubbers, eg clothing materials or waste papers, plastics and the like.

Solution X is particularly useful in dissolving plutonium or a plutonium-containing mixture of actinides and compounds thereof with or without fission products. The term 'fission product' as used herein refers to those elements formed as direct products (or so-called 'fission fragments') in the fission of nuclear fuel and products formed from such direct products by beta decay. Fission products include elements in the range from selenium to cerium including elements such as $_{56}$Ba, $_{40}$Zr, $_{52}$Te $_{55}$Cs and $_{58}$Ce.

The waste material treated by the process of the present invention may also contain as contaminants (in addition to the aforementioned contaminants) heavy metals such as cadmium and chromium.

In Solution X described above the carbonated water may comprise $CO_3^-$ or $HCO_3^-$ ions in aqueous solution.

The pH of the said aqueous solution comprising Solution X may be in the range 5 to 13, especially 5 to 9, and may be controlled using a carbonate such as sodium carbonate to provide the carbonated solution and/or use of another alkaline ingredient.

Desirably, the said process is one which may be carried out at a temperature of less than 35° C. and which gives no toxic or explosive off gases.

Desirably, the said solution contains no ingredients, eg nitrates or sulphates, which will damage building materials, eg concrete, in which the material to be treated might be contained or promote a runaway reaction with uncorroded metals, eg any magnesium present.

The actinide(s), fission product(s), heavy metals and compounds thereof required to be dissolved by Solution X may dissolve in the aqueous medium as a carbonate compound as well as in the form of a complex.

The complexing agent of Solution X may be selected from the anion of a carboxylic acid in the group consisting of citric acid, acetic acid, oxalic acid and EDTA (ethylenediamine tetracetic acid).

The conditioning agent of Solution X may comprise an oxidising agent such as hydrogen peroxide, ozone, oxygen-enriched air or potassium permanganate, or a reducing agent such as hydrazine or hydroxylamine. Hydrogen peroxide is preferred.

Desirably, the complexing agent is present in the said solution in a concentration in the range from 0.0001 to 5 Mol $dm^{-3}$, especially 0.0005 to 0.1 Mol $dm^{-3}$.

Desirably, the said conditioning agent is present in the said solution in a concentration in the range from 0.01 Molar to 3 Molar.

It is believed that the conditioning agent changes the oxidation state of the plutonium and other contaminant metals to a state which renders the metal soluble by forming a complex with the complexing agent and/or by the natural solubility of the conditioned cation in the leaching solution. The complex produced by the complexing agent and the metal may facilitate the oxidation or reduction carried out by the conditioning agent which in turn facilitates dissolution.

For example, it is thought that citrate ions and insoluble plutonium form a soluble plutonium complex, and that the presence of citrate ions facilitates the oxidation of the plutonium by the conditioning agent, eg hydrogen peroxide, to a more soluble oxidation state.

In the process of the present invention the aqueous medium comprising Solution X and the shredded organic waste material to be washed are desirably mixed together by a stirring or churning action in a mixer to permit suitable intimate contact between the solid pieces of the waste and the aqueous medium. The contaminants are washed into the solution comprising the aqueous medium which is separated from the solid waste by a suitable separation process such as decanting, and/or draining and filtration. The filtration may be by one or more of a number of known types of filtration systems such as vacuum filters, pressure filters and ultrafilters. As an alternative to filtration, separation may be achieved by use of centrifuging.

As an alternative to the mixing process the aqueous medium may be percolated through the shredded waste to wash it. The medium may be applied to the waste by spraying for example. In this case however the particles of waste solid need to be small enough to allow all solid surface to be contacted by the aqueous medium.

In the vessel employed for contacting the solid waste to be washed with the aqueous medium the waste may be washed in successive discrete batches. Alternatively, the waste may be continuously fed into and extracted from the vessel.

The dissolved contaminants are desirably recovered in concentrated form from the aqueous medium after separation therefrom of the washed waste.

The recovery may be by one of the known methods employed for recovering contaminants from solutions in which they are dissolved, such as solvent extraction and/or evaporation, and/or ion exchange, and/or floc treatment. Other processes such as reverse osmosis may be employed to purify the separated aqueous liquid medium further which, after purification, may be re-used, eg by recirculation, in the soil washing process.

The contaminant concentrate residue obtained from the above processes may be treated and disposed of in a manner suitable for the type of contaminants involved. For example, plutonium or other actinides may be separated from the residue and subsequently isolated for re-use by selective versions of one or more of the aforementioned separation processes and the subsequent residue may be handled and disposed of by one of the methods known for the disposal of high or intermediate level radioactive waste associated with irradiated nuclear fuel. For example, the residue may be encapsulated in glass by a known vitrification technique carried out remotely within a radiation-stable structure eg made of concrete.

Such actinide separation and residue are vitrification processes currently employed by the present Applicants at their Sellafield reprocessing plant.

The objective of using the process of the present invention is that after the waste washing process has taken place the waste is reduced to a safer state. Normally, it will be transported to a low level storage site. In many cases the state of the waste should be sufficiently safe, either immediately or after a suitable time.

Embodiments of the present invention will now be described by way of example.

EXAMPLE 1

Waste clothing items from use at a nuclear materials processing facility which are contaminated with plutonium together with other actinides and fission products are collected in a radiation stable container. The contents of the container are transported to a shredder where they are shredded into pieces having a surface area not greater than 10 $cm^2$. The shredded pieces are then treated as follows. A solution which is an example of Solution X comprising water, sodium carbonate, sodium citrate (0.1M concentration as a typical example) and $H_2O_2$ (0.1M as a typical example) is continuously sprayed at ambient temperature over the top surface of the shredded waste and is allowed to percolate through the waste to a collecting trough below, where it is collected. The collected solution is transferred to an ion exchange plant where the actinide and fission product complexes are held. The actinides can subsequently be recovered from the resin in a known way, eg by addition of a solution of nitric acid which redissolves the captured actinides, followed by subsequent treatment, eg selective solvent extraction, to separate the individual actinides. The remaining active residue separated from the solution is treated by encapsulation, eg vitrification. The washed waste is allowed to dry by evaporation and is then reboxed and transported to a low level waste disposal site.

EXAMPLE 2

Waste clothing items contaminated with actinides especially Pu, Am and Np and fission products is transported to a treatment site as in Example 1. At the treatment site the waste is shredded and is then transferred to a mixing vessel in which it is thoroughly mixed with the same example of Solution X as employed in Example 1. The mixture is then stirred for about 1 hour after which the excess liquid is drained from the vessel and the remainder of the solution containing the dissolved contaminants is separated from the solid by filtration. The actinides present are separated by redissolution. The remainder of the contaminants are subsequently recovered from the solution containing them by floc treatment. The hazardous residue separated by the floc treatment process is encapsulated and transported to a repository. The washed waste is transported to a disposal site as in Example 1.

EXAMPLE 3

In order to demonstrate the effect of the combination of the ingredients in the three-component solution comprising Solution X as defined above in a process embodying the present invention samples of a solid waste containing actinide contaminants were treated in turn in a glove box with samples of three test solutions as follows:

Solution A: an aqueous solution containing 0.005M sodium citrate; 0.89M $H_2O_2$ and carbon dioxide bubbled in the solution to saturation;

Solution B: an aqueous solution containing 0.005M sodium citrate; plus carbon dioxide bubbled in the solution to saturation;

Solution C: an aqueous solution containing 0.89M $H_2O_2$ plus carbon dioxide bubbled into the solution to saturation.

After contact of the waste sample with Solution A at ambient temperature for 72 hours the following percentages of uranium, plutonium, americium, magnesium antimony and caesium (all present in the original sludge) were found to have been dissolved by the solution: 98, 93, 87, 100, 100, 99 respectively (all percentages may be raised to 100 by increasing the contact time and/or the citrate concentration).

After contact of the sludge sample with Solution B at ambient temperature for 72 hours the dissolution percentages of U, Pu, Am, Mg, Sb and Cs were found to be 70, 62, 76, 100, 94, 62 respectively.

This demonstrates the surprising effectiveness of the three part citrate/$H_2O_2$/$CO_2$ solution as compared with solutions containing only two out of three of these ingredients for treatment of contaminated wastes especially for the dissolution of Pu and Am which are especially hazardous elements if encountered in waste treatment work.

We claim:

1. A process for the treatment of material which is or is suspected to be contaminated with one or more actinides or compounds thereof, which process includes contacting the material with liquid medium which comprises an aqueous solution which is free of heavy metal ions, and comprises ingredients which are naturally degradable to non-toxic products with or without mild physical assistance, said solution comprising:

(a) carbonated water;

(b) a conditioning agent; and (c) a complexing agent which comprises the anion of a carboxylic acid having from 2 to 6 carbon atoms;

wherein the process comprising treating of solid organic wastes which are or are suspected to be contaminated with plutonium or compounds thereof with or without other hazardous contaminants and includes the steps of (1) shredding the organic waste material, (2) intimately mixing the shredded waste material with the liquid medium thereby dissolving contaminants as complexes in said liquid medium, and (3) separating the liquid medium from the shredded waste material thereby reducing the radioactivity level of the organic waste material.

2. A process as in claim 1 wherein the waste treated by the process comprises plutonium-contaminated materials obtained from a plant in which plutonium is handled as a material for use in or a product of a nuclear fission reaction.

3. A process as in claim 1 wherein the waste material treated by the process also contains as contaminants one or more heavy metals.

4. A process as in claim 1, wherein the process is carried out at a temperature of less than 35° C. and gives no toxic or explosive off-gases.

5. A process as in claim 1 wherein the complexing agent is the anion of a carboxylic acid selected from the group consisting of citric acid, acetic acid, oxalic acid and ethylenediamine tetracetic acid.

6. A process as in claim 1 wherein the conditioning agent comprises an oxidizing agent selected from the group consisting of hydrogen peroxide, ozone, oxygen-enriched air and potassium permanganate, or a reducing agent selected from the group consisting of hydrazine and hydroxylamine.

7. A process as in claim 1 wherein the complexing agent is present in the solution in a concentration in the range from 0.0005 to 0.1 Mol $dm^{-3}$.

8. A process as in claim 1 wherein the conditioning agent is present in the solution in a concentration in the range from 0.01 Molar to 3 Molar.

9. A process as in claim 1 wherein the aqueous medium and the shredded organic waste material to be washed are mixed together by stirring or churning in a mixer to permit intimate contact between the solid pieces of the waste and the aqueous medium, and the contaminants are washed in the solution comprising the aqueous medium which is separated from the solid waste.

10. A process as in claim 1 wherein a vessel is employed for contacting the solid waste to be washed with the aqueous medium and the waste is washed in successive discrete batches.

11. A process as in claim 1 wherein a vessel is used for contacting the solid waste with the aqueous medium and the waste is continuously fed into and extracted from the vessel.

12. A process as in claim 1 wherein the dissolved contaminants are recovered in concentrated form from the aqueous medium after separation therefrom of the washed waste.

* * * * *